US007971269B2

(12) United States Patent
Buckley

(10) Patent No.: US 7,971,269 B2
(45) Date of Patent: Jul. 5, 2011

(54) DEVICE FOR CONNECTING AND MAINTAINING A SPORT PAD TO A SKATE

(76) Inventor: Michael Buckley, Andover, MA (US)

( * ) Notice: Subject to any disclaimer, the term of this patent is extended or adjusted under 35 U.S.C. 154(b) by 542 days.

(21) Appl. No.: 11/962,281

(22) Filed: Dec. 21, 2007

(65) Prior Publication Data

US 2008/0148531 A1 Jun. 26, 2008

Related U.S. Application Data

(60) Provisional application No. 60/876,957, filed on Dec. 22, 2006.

(51) Int. Cl.
*A41D 13/05* (2006.01)

(52) U.S. Cl. ..... 2/22; 2/23; 24/265 H; 24/300

(58) Field of Classification Search ..... None
See application file for complete search history.

(56) References Cited

U.S. PATENT DOCUMENTS 720,735 A * 2/1903 Peelle ..... 403/283
967,004 A * 8/1910 Ehikian ..... 2/24
2,059,825 A * 11/1936 Talbott ..... 248/61
5,546,639 A * 8/1996 Lacore et al. ..... 24/265 H
7,458,135 B2 * 12/2008 Mikesell et al. ..... 24/300

* cited by examiner

*Primary Examiner* — Jack W. Lavinder

(74) *Attorney, Agent, or Firm* — Peter A. Nieves; Sheehan Phinney Bass + Green, PA

(57) ABSTRACT

A device for connecting and maintaining a sports pad to a skate, contains a cord having a first end and a second end. A first hook portion is removably connected to the first end of the cord, wherein the first hook portion contains a first anchoring portion and a first clasping portion, the first end of the cord being removably connected to the first clasping portion. The device also contains a first outer cylinder for maintaining the first end of the cord within the first clasping portion and a second hook portion removably connected to the second end of the cord. The second hook portion contains a second anchoring portion and a second clasping portion, where the second end of the cord is removably connected to the second clasping portion. The device also contains a second outer cylinder for maintaining the second end of the cord within the second clasping portion.

8 Claims, 5 Drawing Sheets

DEVICE FOR CONNECTING AND MAINTAINING A SPORT PAD TO A SKATE

CROSS-REFERENCE TO RELATED APPLICATION

This application claims priority to U.S. Provisional Application entitled, "DEVICE FOR CONNECTING AND MAINTAINING A SPORT PAD TO A SKATE," having Ser. No. 60/876,957, filed Dec. 22, 2006, which is entirely incorporated herein by reference.

BACKGROUND OF THE INVENTION

Proper padding is essential for all hockey goalies. Unfortunately, the process of putting on hockey pads is a long and tedious process.

One particular hockey pad of great importance is the leg pad. Leg pads come in many different sizes and styles, but are all designed to protect the front and back of the leg of a goalie. One style of leg pad has two holes located on a bottom portion allowing laces to fit therethrough. During dressing, a leg pad is placed in front and central to a skate. The laces of the leg pad are then run through holes located on a bottom portion of the skate, which is located above a blade of the skate, so as to secure the leg pad to the skate. As an example, the laces may be run in a crisscross pattern through the bottom of the skate. The laces are then brought to a top portion of the skate and tied. Straps are also typically used for connecting a higher portion of the hockey pad to a back portion of the skate, such as by threading the straps through holes located on the back portion of the skate.

Unfortunately, the lacing process takes more time than is desired. In addition, during play, the resulting laces located on the bottom of the skate may become exposed to a hockey puck, hockey stick, or a blade of a skate. This exposure may result in the laces being cut, which results in the goalie having to replace the laces.

Thus, a heretofore unaddressed need exists in the industry to address the aforementioned deficiencies and inadequacies.

SUMMARY OF THE INVENTION

Embodiments of the present invention provide a device for connecting and maintaining a sport pad to a skate. Briefly described, in architecture, one embodiment of the device, among others, can be implemented as follows. The device for connecting and maintaining a sports pad to a skate, contains a cord having a first end and a second end. A first hook portion is removably connected to the first end of the cord, wherein the first hook portion contains a first anchoring portion and a first clasping portion, the first end of the cord being removably connected to the first clasping portion. The device also contains a first outer cylinder for maintaining the first end of the cord within the first clasping portion and a second hook portion removably connected to the second end of the cord. The second hook portion contains a second anchoring portion and a second clasping portion, where the second end of the cord is removably connected to the second clasping portion. The device also contains a second outer cylinder for maintaining the second end of the cord within the second clasping portion.

Other embodiments, features, and advantages of the present invention will be or become apparent to one with skill in the art upon examination of the following drawings and detailed description. It is intended that all such additional embodiments, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention provides a device for connecting and maintaining a sports pad to a skate. While in the present description the skate is described as an ice skate, it should be noted that the skate might be any other class of skate that would allow the present device to be connected to laces of the skate. It should also be noted that the skate may be replaced by any shoe or sneaker having laces. Alternatively, it should be noted that the device may be connected to straps if the straps have a width permitting connection thereto, or if the skate has a separate connection point.

Figure 1:
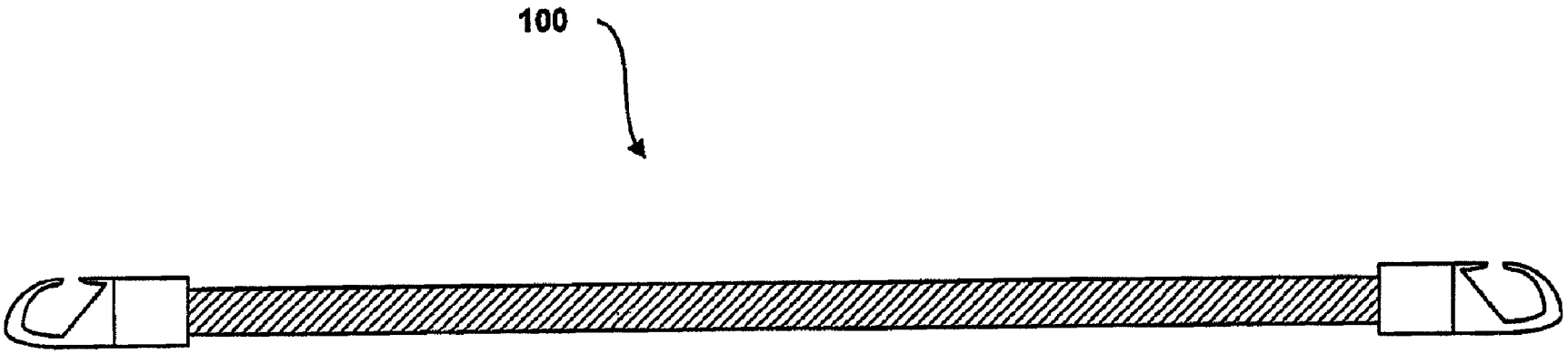
FIG. 1 is a schematic diagram illustrating a connection device, in accordance with a first exemplary embodiment of the invention.

FIG. 1 is a schematic diagram illustrating a connection device 100, in accordance with a first exemplary embodiment of the invention. While FIG. 1 illustrates the connection device 100 fully assembled, FIG. 2 illustrates the connection device 100 having its components separated for better understanding of use and assembly.

Figure 2:
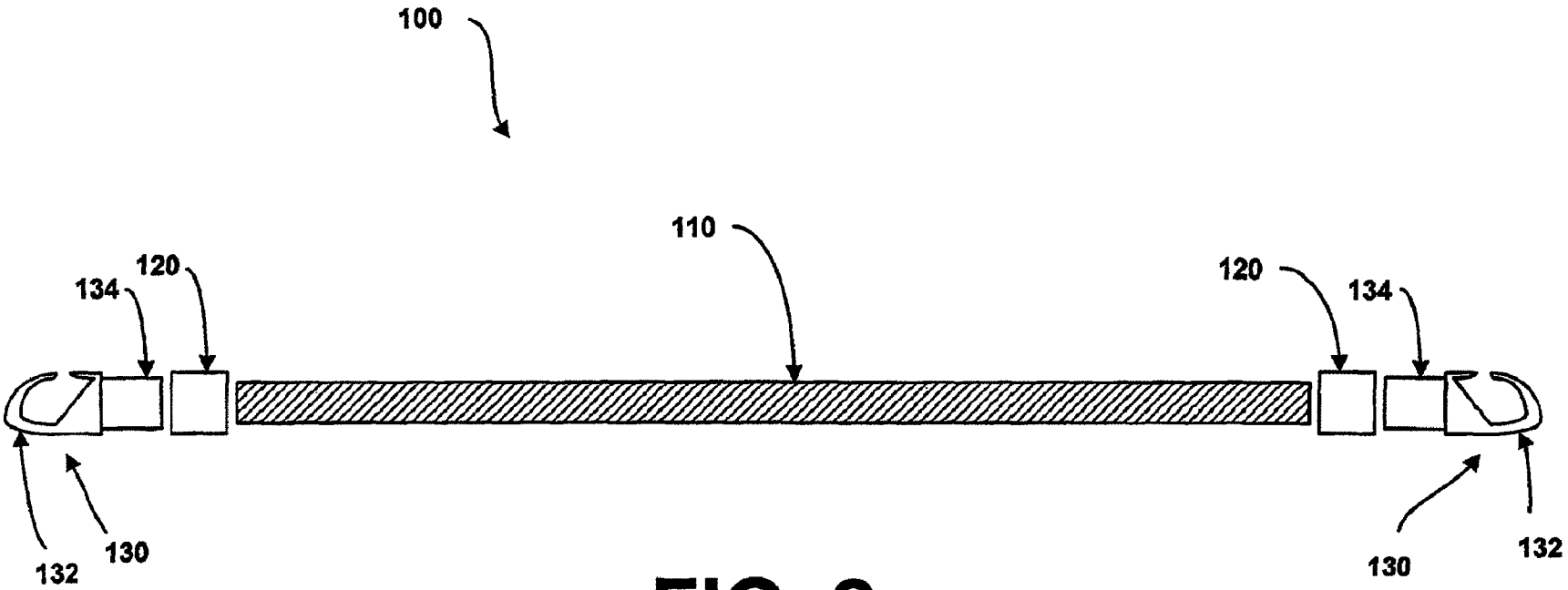
FIG. 2 is a schematic diagram illustrating the connection device of FIG. 1 separated into different parts.

Referring to FIG. 2, the connection device 100 contains an elongated cord 110 having a length defined by a distance required for the connection device 110 to extend from a first connection point on skate laces, through leg pads, and back to a second connection point on the skate laces. The elongated cord 110 may be made of one or more of many different categories of material. As an example, the elongated cord 110 maybe fabricated from an elastic material, similar to that utilized for creating a bungee cord. Alternatively, the elongated cord 110 may be fabricated from material that is not elastic. In accordance with another alternative embodiment of the invention, the elongated cord 110 may have a metallic wire located therein so as to provide extra strength to the elongated cord 110.

The connection device 100 also contains a hook portion 130 and an outer cylinder 120. Two hook portions 130 and two outer cylinders 120 are provided, where one hook portion 130 and one outer cylinder 120 is located on each end of the elongated cord 110. The hook portion 130 contains an anchoring portion 132 and a clasping portion 134. The anchoring portion 132 is shaped like a hook to allow removable connection to a lace of the skate. Preferably, the anchoring portion 132 has an opening that permits easy insertion of the lace, as is explained in detail hereinbelow. It is also preferred that with tension placed on the elongated cord 110, the anchoring portions 132 maintain their connection to the lace. It should be noted that, in accordance with an alternative embodiment of the invention, the anchoring portion 132 may have the capability of being entirely enclosed after insertion of the lace, so as to prevent removal of the anchor portion 132 from the lace if tension is removed from the elongated cord 110.

The clasping portion 134 is an extension of the anchoring portion 132 and contains a mechanism capable of removably connecting to a first end of the elongated cord 110. As an example, the mechanism may contain teeth that are capable of securing the elongated cord 110 therein (shown by FIG. 3). To maintain the teeth on the elongated cord 110, the outer cylinder 120 is placed over an outside portion of the clasping portion 134, thereby maintain pressure on the clasping portion 134 and preventing the teeth from opening and allowing the elongated cord 110 to separate from the hook portion 130.

It should be noted that multiple different mechanisms may be utilized for maintaining connection between the elongated cord 110 and the hook portion 130. In addition, in accordance with an alternative embodiment of the invention, the elongated cord 110 may be permanently connected to the hook portion 130, although this embodiment would prevent replacement on the elongated cord 110 if damaged.

Similar to the elongated cord 110, the hook portion 130, may be fabricated from multiple different materials. As an example, the hook portion 130 may be fabricated from plastic, metal, or a type of ceramic.

Figure 3:
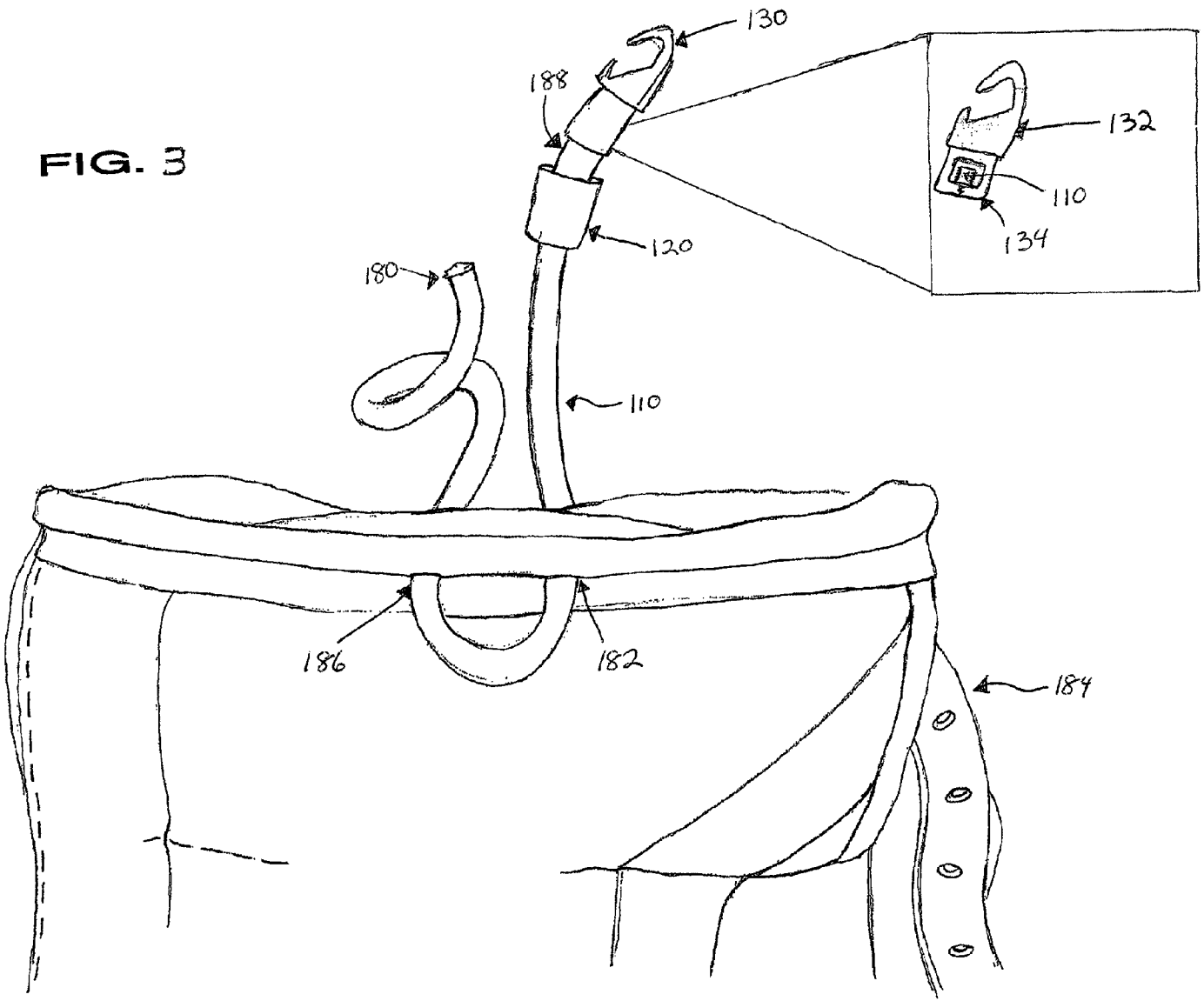
FIG. 3 is a schematic diagram further illustrating the clasping portion, in accordance with the first exemplary embodiment of the invention.

FIG. 3 is an image illustrating a step in removably securing the connection device 100 to both the leg pad and skate. As is shown by FIG. 3, a first end 180 of the elongated cord 110 is run through a first pad eyelet 182 or hole that is punched into a central portion of a leg pad 184. A portion of the elongated cord 110 that is run through the pad eyelet or hole does not yet have the hook portion 130 or outer cylinder 120 connected thereto. The first end 180 of the elongated cord 110 is then run through a second pad eyelet 186 or hole, resulting in the first end 180 and a second end 188 of the elongated cord 110 being located on the same side of the leg pad 184.

The elongated cord 110 may then be threaded into the clasping portion 134. To maintain teeth of the clasping portion 134 on the elongated cord 110, the outer cylinder 120 is placed over the clasping portion 134, thereby preventing the teeth from opening and allowing the elongated cord 110 to separate from the hook portion 130. This process is repeated so that both hook portions 130 and outer cylinders 120 are connected to the elongated cord 110.

Figure 4:
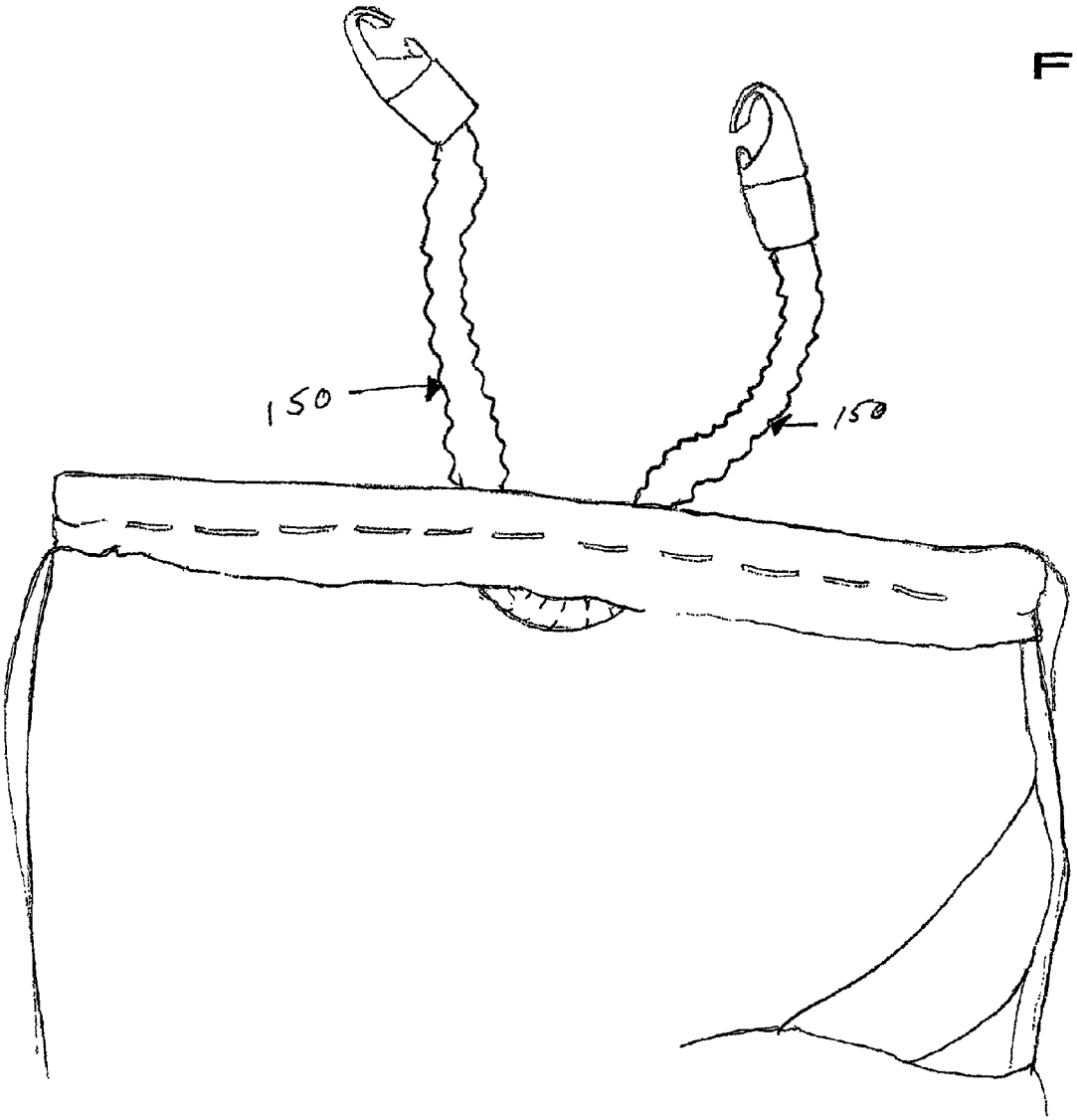
FIG. 4 is a schematic diagram further illustrating the connection device covered by a protective shield.

In accordance with an alternative embodiment of the invention, exposed portions of the elongated cord 110, may be covered by a protective shield 150. FIG. 4 is a schematic diagram further illustrating the connection device 100 covered by a protective shield 150. The protective shield 150 may be fabricated from a material that is more durable than material utilized for fabricating the elongated cord 110. As an example, the protective shield 150 may be fabricated from a sturdy plastic that is resistant to cutting or other forms of damage. Alternatively, a sturdy nylon may be used for the protective shield 150. Use of the protective shield 150 serves to elongate life of the connection device 100. It should be noted that the protective shield 150 may be provided as a single sheath or more than one sheath. Of course, other methods of protecting the elongated cord 110 may be provided, and such other methods are intended to be included within the present disclosure.

Figure 5:
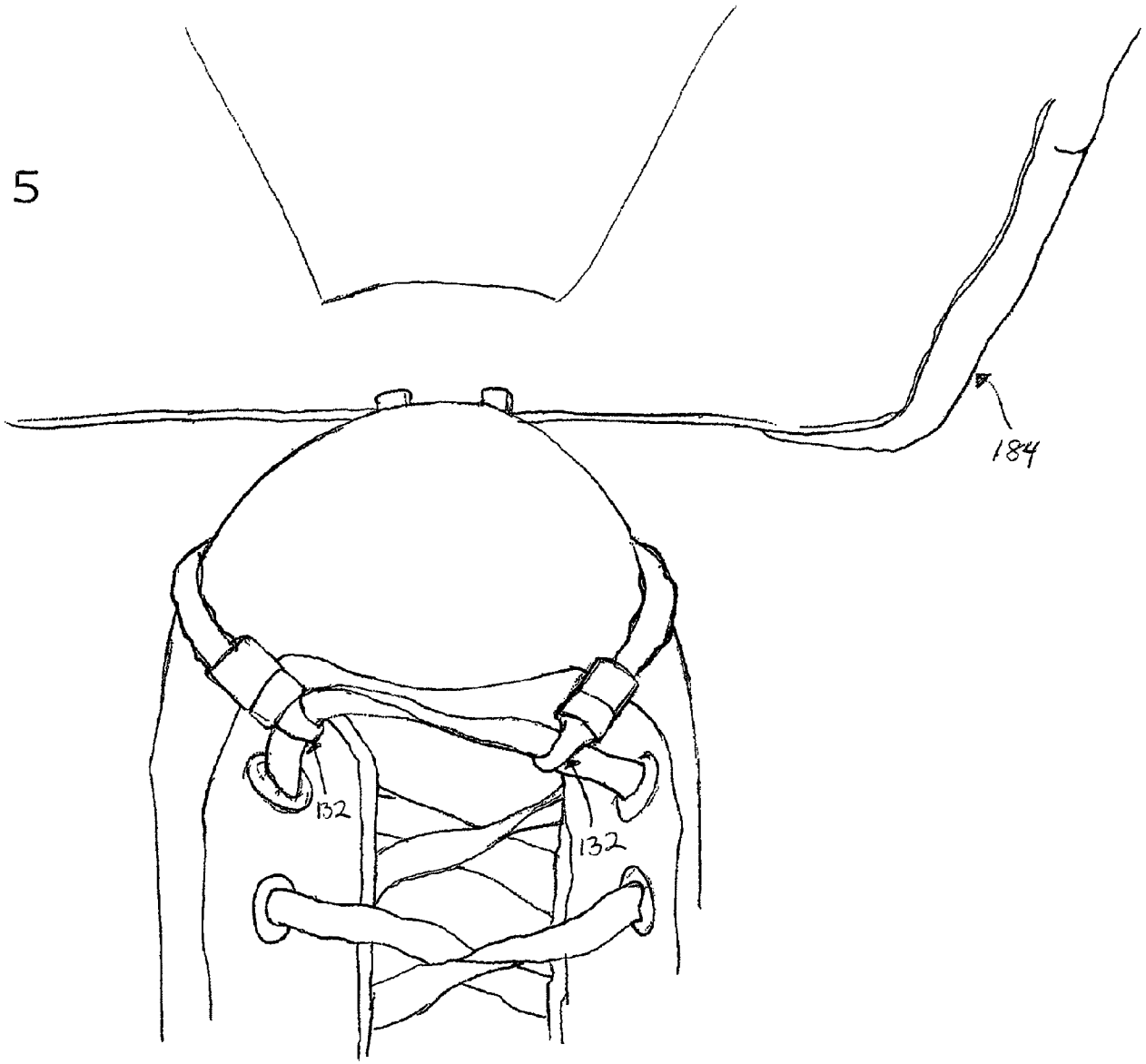
FIG. 5 is an image illustrating a final step in removably securing the connection device to both the leg pad and skate.

FIG. 5 is an image illustrating a final step in removably securing the connection device 100 to both the leg pad and skate. As is shown by FIG. 5, the anchoring portions 132 are removably connected to the lace of the skate. Specifically, the first anchoring portion 132 is removably connected to a left side of the lace and the second anchoring portion 132 is removably connected to a right side of the lace. The leg pad 184 is also illustrated.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention.

I claim:

1. A system for removably securing and maintaining a goalie pad to a skate, comprising:

a goalie pad, wherein a bottom portion of the goalie pad contains a first pad eyelet and a second pad eyelet, wherein the first pad eyelet and the second pad eyelet are located central to the bottom portion of the goalie pad; and an apparatus removably connected to the goalie pad and the skate, wherein the apparatus further comprises:

a cord having a first end and a second end, wherein the cord extends through the first pad eyelet and through the second pad eyelet;

a first hook portion removably connected to the first end of the cord, wherein the first hook portion comprises a first anchoring portion and a first clasping portion, wherein the first clasping portion contains an outer surface, the first end of the cord being removably connected to the first clasping portion;

a second hook portion removably connected to the second end of the cord, wherein the second hook portion comprises a second anchoring portion and a second clasping portion, wherein the second clasping portion contains an outer surface, the second end of the cord being removably connected to the second clasping portion;

a first elongated outer cylinder that is positioned, maintained, and covers the entire outer surface of the first clasping portion, wherein the first elongated outer cylinder maintains the first end of the cord within the first clasping portion; and a second elongated outer cylinder that is positioned, maintained, and covers the entire outer surface of the second clasping portion, wherein the second elongated outer cylinder maintains the second end of the cord within the second clasping portion.

2. The system of claim 1, wherein the cord further comprises a sheath for protecting the cord, wherein the sheath encapsulates the cord.

3. The system of claim 1, wherein the first and second anchoring portions have an opening for permitting laces of the skate to fit therein.

4. The system of claim 1, wherein the cord is elastic.

5. The system of claim 1, wherein the cord contains a metallic wire therein.

6. The system of claim 1, wherein the first anchoring portion and the second anchoring portion are shaped as hooks.

7. The system of claim 1, wherein the first clasping portion and the second clasping portion contain teeth for grasping the cord.

8. The system of claim 1, wherein the first clasping portion also contains a central opening, wherein the central opening of the first clasping portion, when secured to the first end of the cord, contains a tip portion of the first end extending therein; and wherein the second clasping portion also contains a central opening, wherein the central opening of the second clasping portion, when secured to the second end of the cord, contains a tip portion of the second end extending therein.

* * * * *